US011015491B2

(12) United States Patent
Nichols et al.

(10) Patent No.: US 11,015,491 B2
(45) Date of Patent: May 25, 2021

(54) MECHANISM FOR LOCKING A VARIABLE CAM TIMING DEVICE

(71) Applicant: BorgWarner Inc., Auburn Hills, MI (US)

(72) Inventors: Jared D. Nichols, Johnstown, PA (US); Won-Jung Kwon, Cheongbuk-myeon (KR)

(73) Assignee: BorgWarner Inc., Auburn Hills, MI (US)

( * ) Notice: Subject to any disclaimer, the term of this patent is extended or adjusted under 35 U.S.C. 154(b) by 0 days.

(21) Appl. No.: 16/327,389

(22) PCT Filed: Aug. 23, 2017

(86) PCT No.: PCT/US2017/048148
§ 371 (c)(1),
(2) Date: Feb. 22, 2019

(87) PCT Pub. No.: WO2018/039308
PCT Pub. Date: Mar. 1, 2018

(65) Prior Publication Data

US 2019/0203617 A1 Jul. 4, 2019

Related U.S. Application Data

(60) Provisional application No. 62/378,748, filed on Aug. 24, 2016.

(51) Int. Cl.
*F01L 1/344* (2006.01)

(52) U.S. Cl.
CPC ... *F01L 1/3442* (2013.01); *F01L 2001/34423* (2013.01); *F01L 2001/34453* (2013.01);
(Continued)

(58) Field of Classification Search
CPC . F01L 1/344; F01L 1/342; F01L 2001/34456; F01L 2001/34469
(Continued)

(56) References Cited

U.S. PATENT DOCUMENTS 2,130,618 A * 9/1938 Gnavi ..... F15B 15/261 91/44
5,797,361 A * 8/1998 Mikame ..... F01L 1/3442 123/90.17
(Continued)

FOREIGN PATENT DOCUMENTS

CN 1495344 A 5/2004
DE 102008059196 A1 6/2010
(Continued)

OTHER PUBLICATIONS

International Search Report for PCT/US2017/048148 dated Dec. 1, 2017.

*Primary Examiner* — Jorge L Leon, Jr.
(74) *Attorney, Agent, or Firm* — Brown & Michaels, PC

(57) ABSTRACT

A lock pin for a VCT device that has a locked position, locking a housing assembly relative to a rotor assembly of the variable cam timing device, and an unlocked position. The lock pin has a body comprising a first diameter with a first area, a second diameter with a second area, and a chamber formed between the first area of the first diameter and the second area of the second diameter for receiving fluid, the first area being greater than the second area. When fluid is applied to the chamber through the variable cam timing phaser, a difference between first area and the second area defining the chamber creates a force imbalance, such that the oil pressure applied to the chamber of the body assists in maintaining the Sock pin in the locked position.

3 Claims, 12 Drawing Sheets

(52) U.S. Cl.
CPC ..... *F01L 2001/34456* (2013.01); *F01L 2001/34469* (2013.01)

(58) Field of Classification Search
USPC ..... 123/90.15–90.18
See application file for complete search history.

(56) References Cited

U.S. PATENT DOCUMENTS 5,924,395 A 7/1999 Moriya et al.
6,443,112 B1 9/2002 Kinugawa
6,505,586 B1 * 1/2003 Sato ..... F02D 13/0234 123/90.15
6,745,735 B2 6/2004 Smith
8,356,583 B2 1/2013 Smith
8,360,022 B2 1/2013 Ozawa et al.
8,631,744 B2 1/2014 Fujiwaki et al.
8,893,677 B2 11/2014 Smith
9,022,000 B2 5/2015 Kanai
9,080,475 B2 7/2015 Kobayashi et al.
9,127,575 B2 9/2015 Fischer et al.
2003/0196625 A1 * 10/2003 Smith ..... F01L 1/3442 123/90.17
2003/0217717 A1 11/2003 Pierik et al.
2007/0017463 A1 1/2007 Mott et al.
2007/0245994 A1 * 10/2007 Methley ..... F01L 1/344 123/90.17
2008/0251042 A1 10/2008 Hayase et al.
2011/0017156 A1 * 1/2011 Smith ..... F01L 1/3442 123/90.15
2011/0168114 A1 * 7/2011 Kobayashi ..... F01L 1/022 123/90.17
2012/0255509 A1 * 10/2012 Lichti ..... F01L 1/3442 123/90.15
2013/0104820 A1 * 5/2013 Watanabe ..... F01L 1/3442 123/90.15
2014/0224198 A1 * 8/2014 Morehead ..... F01L 1/3442 123/90.15
2015/0027393 A1 * 1/2015 Noguchi ..... F01L 1/356 123/90.17
2016/0010515 A1 * 1/2016 Snyder ..... F01L 1/3442 123/90.15
2016/0024979 A1 * 1/2016 Busse ..... F01L 1/3442 123/90.17
2016/0084120 A1 3/2016 Sato
2016/0222835 A1 * 8/2016 Narita ..... F01L 1/34
2017/0130619 A1 * 5/2017 Zschieschang ..... F01L 1/3442
2017/0292415 A1 * 10/2017 Sato ..... F01L 1/047

FOREIGN PATENT DOCUMENTS

DE 102014205568 A1 3/2014
WO 2012061233 A2 5/2012
WO 2015041280 A1 9/2014

* cited by examiner

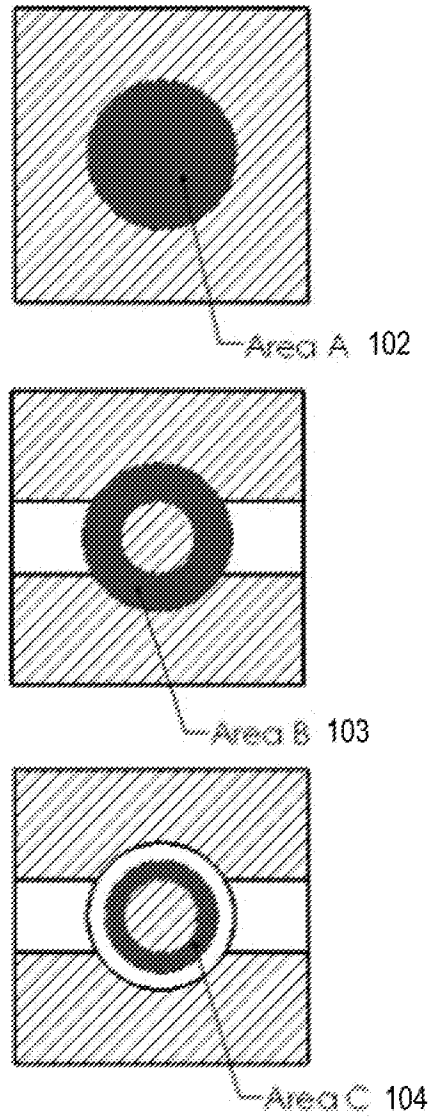
Fig. 1b
Fig. 1c
Fig. 1d
Fig. 1a
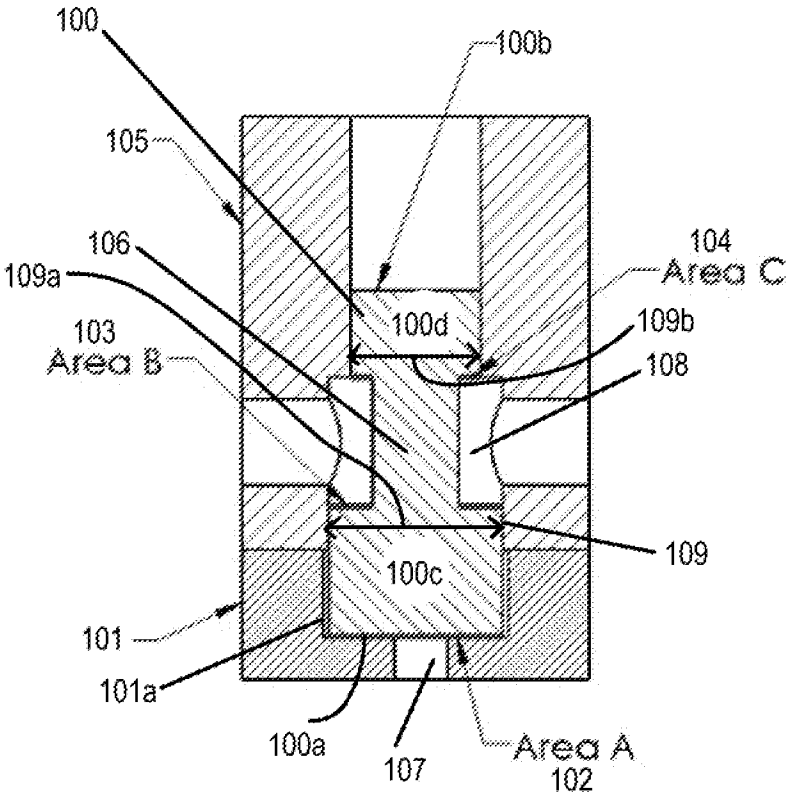

MECHANISM FOR LOCKING A VARIABLE CAM TIMING DEVICE

BACKGROUND OF THE INVENTION

Field of the Invention

The invention pertains to the field of Variable Camshaft Timing (VCT) devices. More particularly, the invention pertains to a mechanism for locking the position of the variable cam timing device.

Description of Related Art

Variable Camshaft Timing (VCT) devices may use a lock pin to fix the timing between the camshaft and the crankshaft without Engine Control Unit (ECU) input. VCT devices may use a spring to maintain lock pin engagement. When a command is given for the VCT device to alter the timing, engine oil pressure may be used to overcome the spring force and retract the lock pin, allowing the VCT device to phase.

Under certain engine conditions, when the VCT device is locked, hydraulic and mechanical inputs on the VCT device may cause the lock pin to unlock, resulting in uncommanded phasing between the camshaft and crankshaft. The uncommanded unlock and resulting uncontrolled phasing of the VCT device can cause decreased engine efficiency and other engine related issues.

SUMMARY OF THE INVENTION

To combat the uncommanded phasing between the camshaft and crankshaft due to the lock pin unlocking, the lock pin of the present invention has a pressure area in the locking direction, which utilizes engine oil pressure to create a net force in the lock direction to maintain the VCT device in the locked position.

A lock pin with multiple diameters is provided within a VCT device. The lock pin default position is a locked position in which a nose of the lock pin engages a pin pocket in an end plate which engages the engine timing drive, preventing relative movement between a rotor (fixed to the camshaft) and the end plate engaging with the timing drive. When the lock pin is commanded to unlock by the ECU, engine oil pressure is directed to the nose of the lock pin and the lock pin retracts from the pin pocket resulting in an unlocked condition or position in which relative movement between the rotor and the end plate is allowed.

The lock pin may be "T" shaped with two distinct diameters. The lock pin is received in a bore of the rotor that has multiple diameters that create a dynamic hydraulic seal with the lock pin. A first area (Area A) of the lock pin is present on the nose or top of the first head end of the lock pin that is received by a pin pocket in a plate of the VCT phaser or device. A second area (Area B) is present on the underside of the head end of the lock pin.

The lock pin may be "1" shaped with three distinct diameters with the smallest diameter being in the middle of two larger diameters. The lock pin is received in a bore of the rotor that has multiple diameters that create a dynamic hydraulic seal with the lock pin. The first area (Area A) of the lock pin is present on the nose or top of the first head end of the lock pin that is received by a pin pocket in a plate of the VCT phaser. The second area (Area B) is present on the underside of the head end of the lock pin. The third area (Area C) is present opposite the second area at the second end of the lock pin. The first area (A) is greater than the second area (B) and the second area (B) is greater than the third area (C). The second area (B) and the third area (C) of the lock pin form a hydraulic chamber, with the second area (B) being perpendicular to the locking direction of the lock pin and the third, smaller area (C) being perpendicular to an unlocking direction. Pressure applied to a hydraulic chamber formed between the second area (B) and the third area (C) results in a force imbalance, inducing the lock pin to move to the locked position or remain in the locked position and therefore, a net positive force is present in the locking direction when this hydraulic chamber is pressurized. The first area (A) is preferably larger than the second (B) and third areas (C) so that a single oil pressure source is able to overcome the locking force to unlock when commanded by the ECU.

Engine oil provided to the hydraulic chamber formed between the second and third areas prevents the pin from the unlocking, and moves the lock pin towards the locked position when the pin is unlocked. Therefore, unequal pressure areas of the lock pin are used to move the lock pin to a locked position and maintain the locked position until the ECU commands the lock pin to unlock and directs oil pressure to the noise of the lock pin corresponding to the first area.

In an alternate embodiment, the lock pin is "T"-shaped.

BRIEF DESCRIPTION OF THE DRAWING

FIG. 1*a* shows a schematic of a lock pin with three pressure areas in a first embodiment of the present invention.

FIG. 1*b* shows an end view of area A, the nose of the lock pin.

FIG. 1*c* shows an end view of area B, the hydraulic chamber area in the locking direction.

FIG. 1*d* shows an end view of area C, the hydraulic chamber area in the unlocking direction.

DETAILED DESCRIPTION OF THE INVENTION

Figure 2:
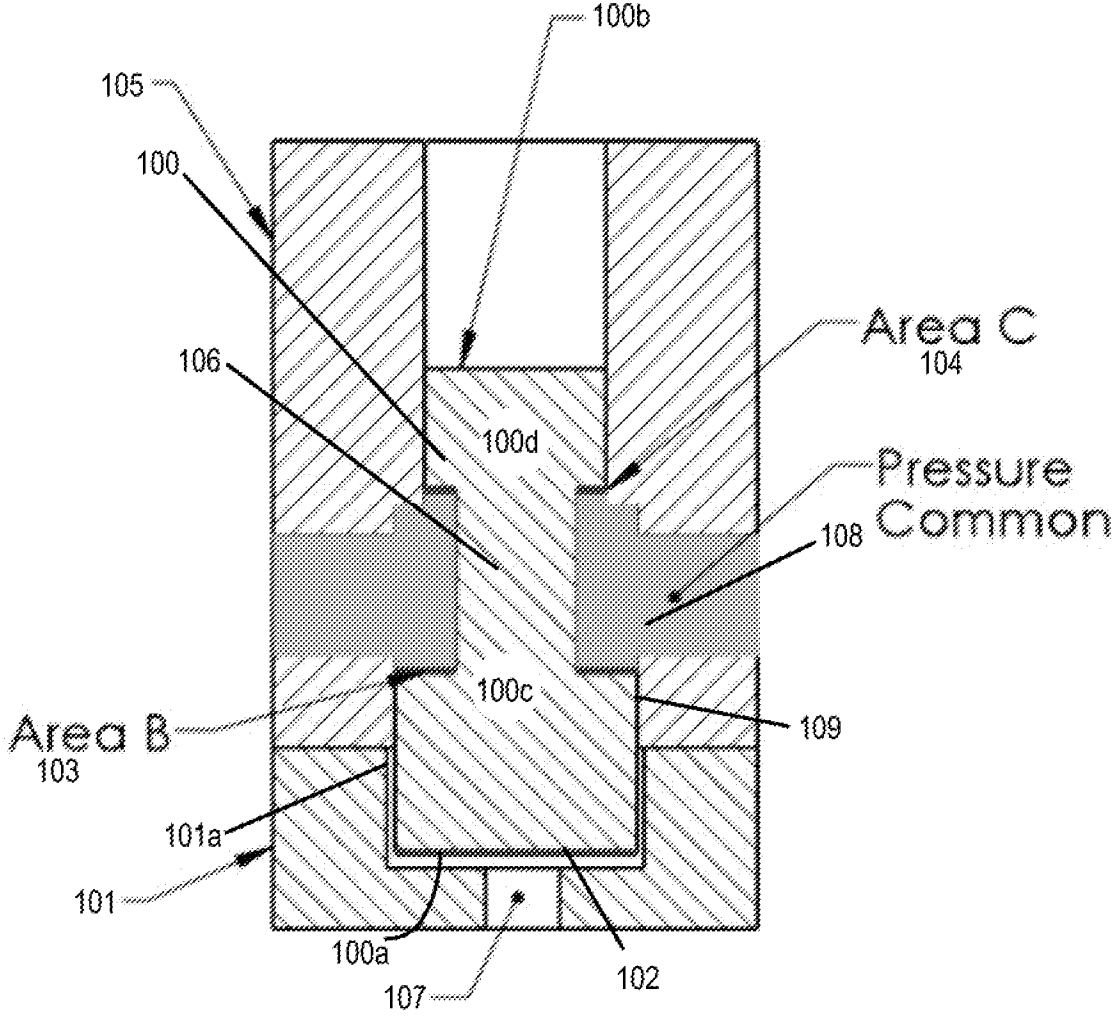
FIG. 2 shows a schematic of locking the lock pin of FIGS. 1*a*-1*d*.

FIGS. 1*a*-1*d* show a lock pin of a first embodiment in which the lock pin has three separate areas. An "I" shaped lock pin 100 with a first end 100*a* and a second end 100*b* is received within a stepped bore 109 of a rotor 105 of a VCT device or phaser. The stepped bore 109 has a first diameter 109*a* and a second diameter 109*b*.

The first end 100*a* of the lock pin 100 is received within a pin pocket 101*a* of the end plate 101 of the phaser. Oil pressure in the pin pocket 101*a* may by controlled by the ECU for venting to relock, or pressurizing to unlock the lock pin 100 by moving the nose of the lock pin 100.

The first end 100*a* of the lock pin 100 has an Area A 102 and is a top surface of the top line of the "I" or first land 100*c*. The under surface of the top line of the "I" forms the second Area B 103. The top surface of the bottom line of the "I" or second land 100*d* forms the third Area C 104. Area B 103 and Area C 104 are connected by a reduced diameter 106 of the lock pin 100, so that Area B 103 and Area C 104 can move together as a unit. The surface of Area A 102 is greater than the surface of Area B 103. The surface of Area B 103 is greater than the surface of Area C 104. The first land 100*c* and the second land 100*d* each have a different diameter, with the first land 100*c* being received within the first diameter 109*a* of the stepped bore 109 and the second land 100*d* being received within the second diameter 109*b* of the stepped bore 109 of the rotor 105. A hydraulic chamber 108 is formed between the second Area B 103, the third Area C 104, the reduced diameter 106 of the lock pin 100, and the stepped bore 109 of the rotor 105. The second Area B 103 is perpendicular to the locking direction of the lock pin 100 and the third, smaller Area C 104 is perpendicular to the unlocking direction. Pressure applied to the hydraulic chamber 108 formed between the second Area B 103 and the third Area C 104 results in a force imbalance inducing the lock pin 100 to move to the locked position or remain in the locked position.

The lock pin 100 has a locked position in which the first end 100*a* of the lock pin 100 engages a pin pocket 101*a* in an end plate 101 of the phaser, preventing relative movement between a rotor 105 and an endplate 101 of the VCT phaser. The lock pin 100 also has an unlocked position in which relative movement between the rotor 105 and the end plate 101 is allowed.

The unequal pressure Areas A-C allow the position of the lock pin 100 to be controlled using pressure supplied to the first end 100*a* of the lock pin 100 and pressure to a common port or chamber 108 from the engine source oil. When the first end 100*a* of the lock pin 100 is vented through vent 107, the lock pin 100 will be held in the locking position due to a net force generated from engine source oil. When oil pressure is commanded to the nose of the lock pin 100*a* by the ECU, the lock pin 100 will overcome the force in the locking direction and move to an unlocked position.

Referring to FIG. 2, fluid is provided from an engine supply (not shown) to the hydraulic chamber 108. With the fluid in the hydraulic chamber 108, there is a net positive area in the locking direction (direction towards the pin pocket 101*a* of the end plate 101) since Area B 103 is greater than Area C 104. The pressure of the fluid on Area B 103 causes the first end 100*a* of the lock pin 100 to move towards and engage the pin pocket 101*a* of the end plate 101. With the net positive area in the locking direction, the lock pin 100 is prevented from unlocking unless commanded to by the ECU. The pin pocket 101*a* is vented to atmosphere when the ECU is commanding the phaser to lock. The pressure in the hydraulic chamber 108 is equal to the engine oil pressure.

Figure 3:
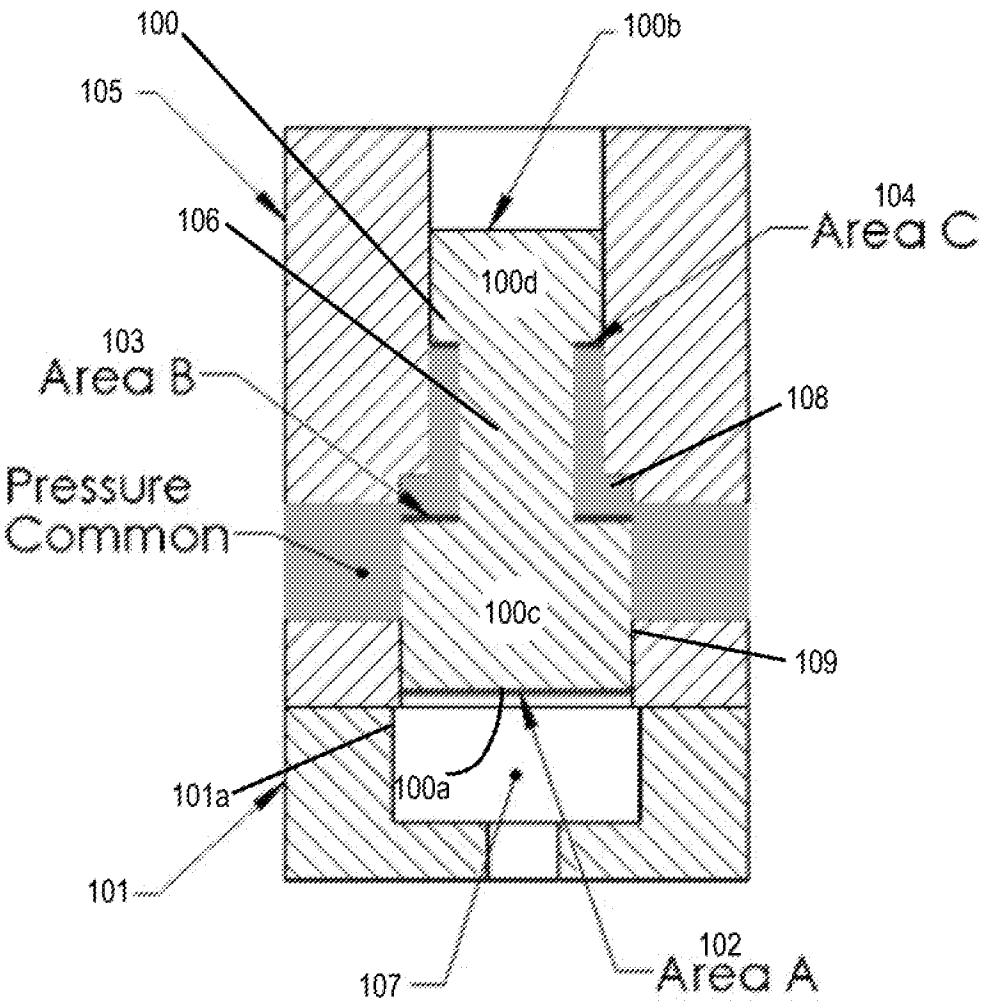
FIG. 3 shows a schematic of relocking the lock pin of the first embodiment of the present invention.

FIG. 3 shows the lock pin 100 moving from an unlocked position to a locked position or "relocking". Fluid is provided from an engine supply (not shown) to the hydraulic chamber 108. The lock pin nose 100*a*, Area A 102 and the pin pocket 101*a* is vented to atmosphere. With the fluid in the hydraulic chamber 108, there is a net positive area in the locking direction (direction towards the pin pocket 101*a* of the end plate 101) since Area B 103 is greater than Area C 104. The pressure in the hydraulic chamber 108 is equal to the engine source oil pressure. The pressure of the fluid on Area B 103 causes the first end 100*a* of the lock pin 100 to move towards and engage the pin pocket 101*a* of the end plate 101.

Figure 4:
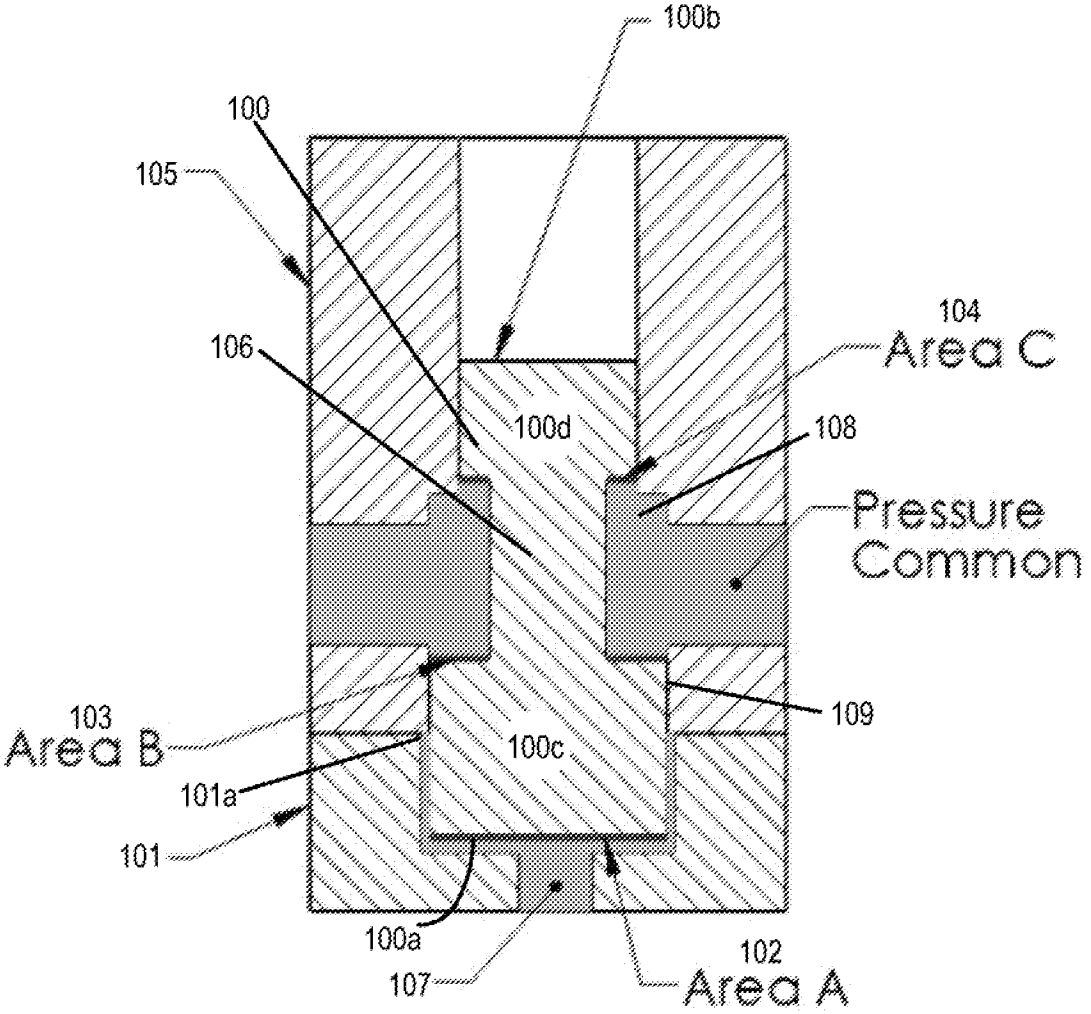
FIG. 4 shows a schematic of unlocking the lock pin of the first embodiment of the present invention.

FIG. 4 shows how the lock pin 100 is moved to an unlocked position. To unlock the lock pin 100, fluid is provided from an engine supply (not shown) to the hydraulic chamber 108 as well as to the first end 100*a* of the lock pin 100. With hydraulic fluid being applied to the hydraulic chamber 108 and the first end 100*a* of the lock pin 100, there is a net positive area in an unlocking direction, since fluid is being applied to Area A 102 and Area C 104, which is greater than Area B 103. The lock pin 100 moves in an unlocking direction, such that the first end 100*a* of the lock pin 100 is no longer engaged with the pin pocket 101*a* of the end plate 101. The pressure applied to the hydraulic chamber 108 is equal to the pressure provided to the first end 100*a* of the lock pin 100 by engine source oil pressure.

Internal combustion engines have employed various mechanisms to vary the relative timing between the camshaft and the crankshaft for improved engine performance or reduced emissions. The majority of these variable camshaft timing (VCT) mechanisms or devices use one or more "vane phasers" on the engine camshaft (or camshafts, in a multiple-camshaft engine). As shown in the figures, vane phasers have a rotor 105 with one or more vanes, mounted to the end of the camshaft, surrounded by a housing assembly with the vane chambers into which the vanes fit. The housing's outer circumference may form the sprocket, pulley or gear accepting drive force through a chain, belt, or gears, usually from the crankshaft, or possibly from another camshaft in a multiple-cam engine. The housing assembly preferably includes the end plates 101.

Figure 5:
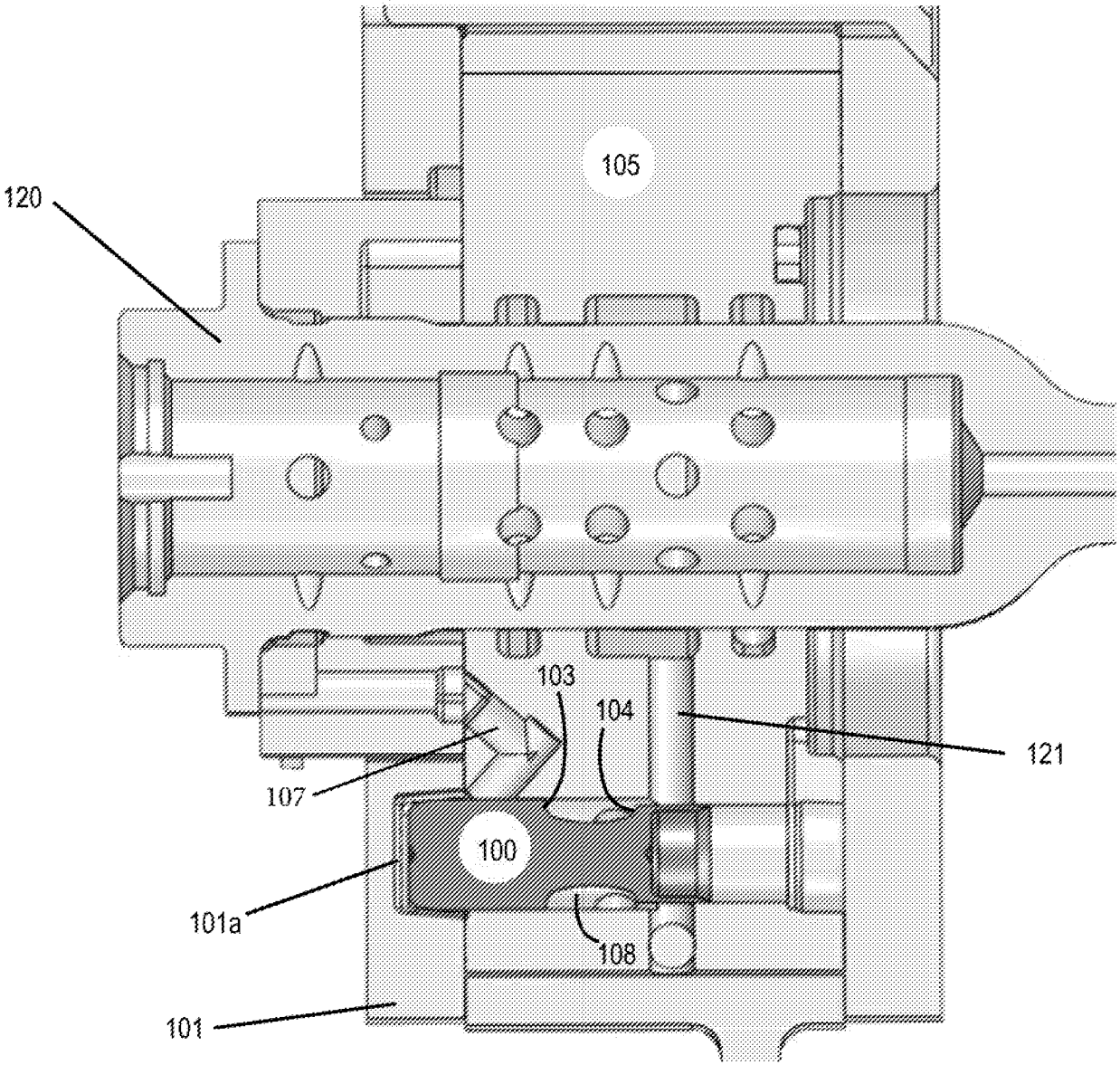
FIG. 5 shows a cross-section of a phaser with a lock pin of the first embodiment in a locked position.
Figure 7:
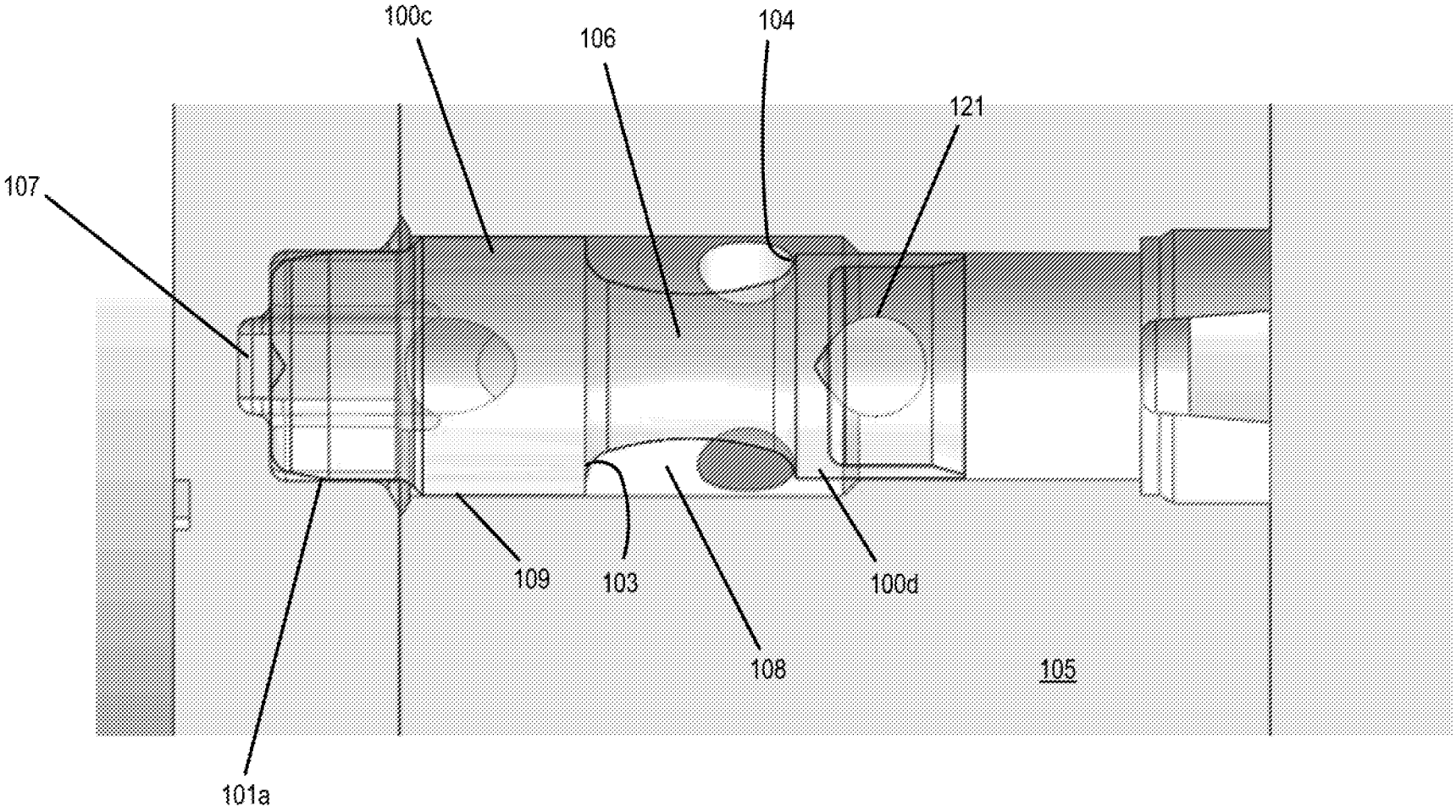
FIG. 7 shows a close up of the lock pin of the first embodiment when the phaser is locked.

FIGS. 5 and 7 show a lock pin of a phaser in a locked position, preventing the movement of the rotor relative to the housing of the phaser, when the control valve of the phaser is commanding the phaser to lock.

Engine oil pressure is provided to the hydraulic chamber 108 from the control valve (not shown) through a passage 121 in the center bolt 120. There is a net positive area in the locking direction (direction towards the pin pocket 101*a* of the end plate 101) since Area B 103 is greater than Area C 104. The pressure of the fluid on Area B 103 causes the first end 100*a* of the lock pin 100 to move towards and engage the pin pocket 101*a* of the end plate 101. With the net positive area in the locking direction, the lock pin 100 is prevented from unlocking due to engine conditions. The pin pocket 101*a* is vented 107 to atmosphere through the center bolt 120. The pressure in the hydraulic chamber 108 is equal to the engine oil pressure.

Figure 6:
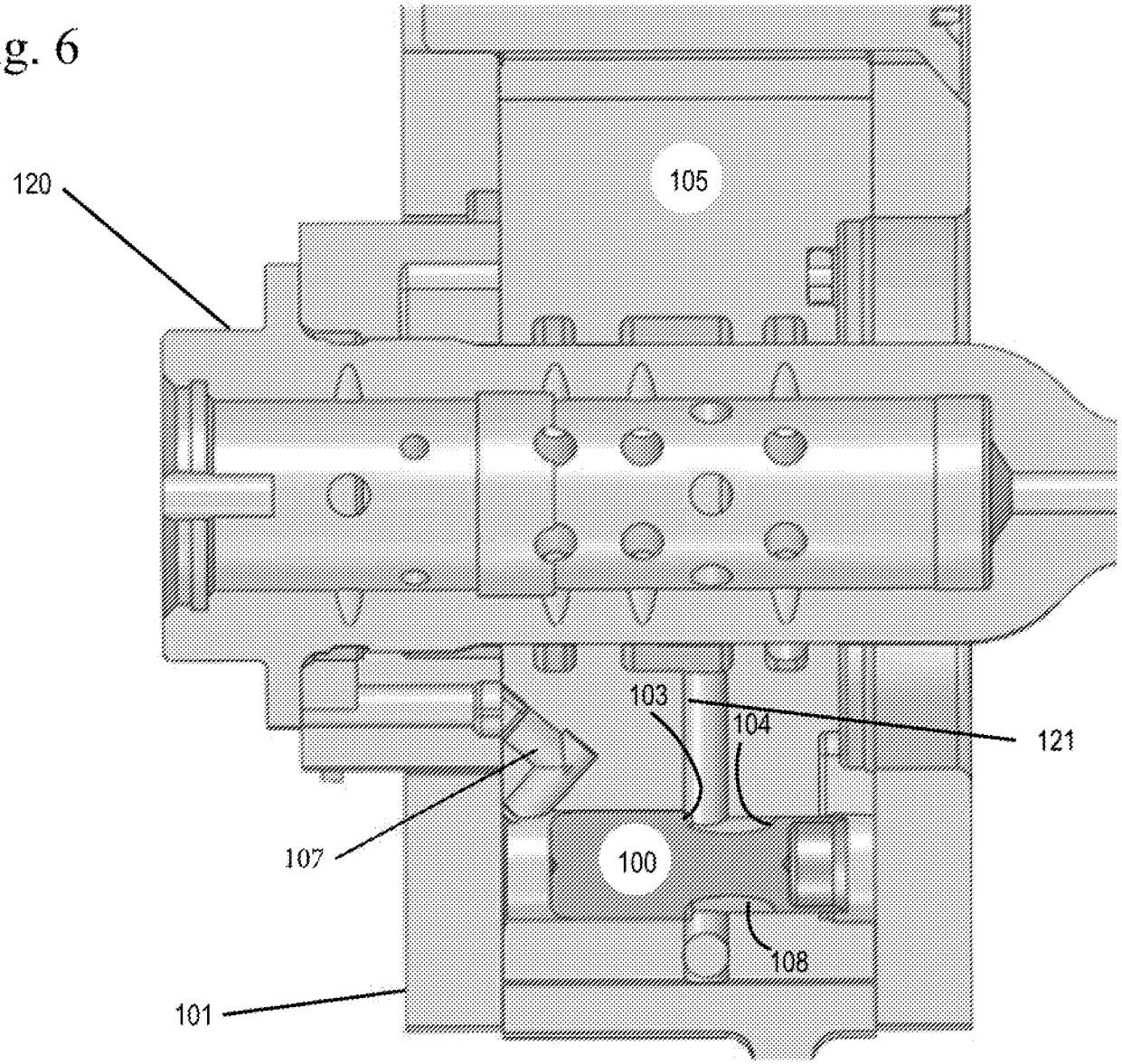
FIG. 6 shows a cross-section of a phaser during normal phasing operation with the lock pin of the first embodiment in an unlocked position.
Figure 8:
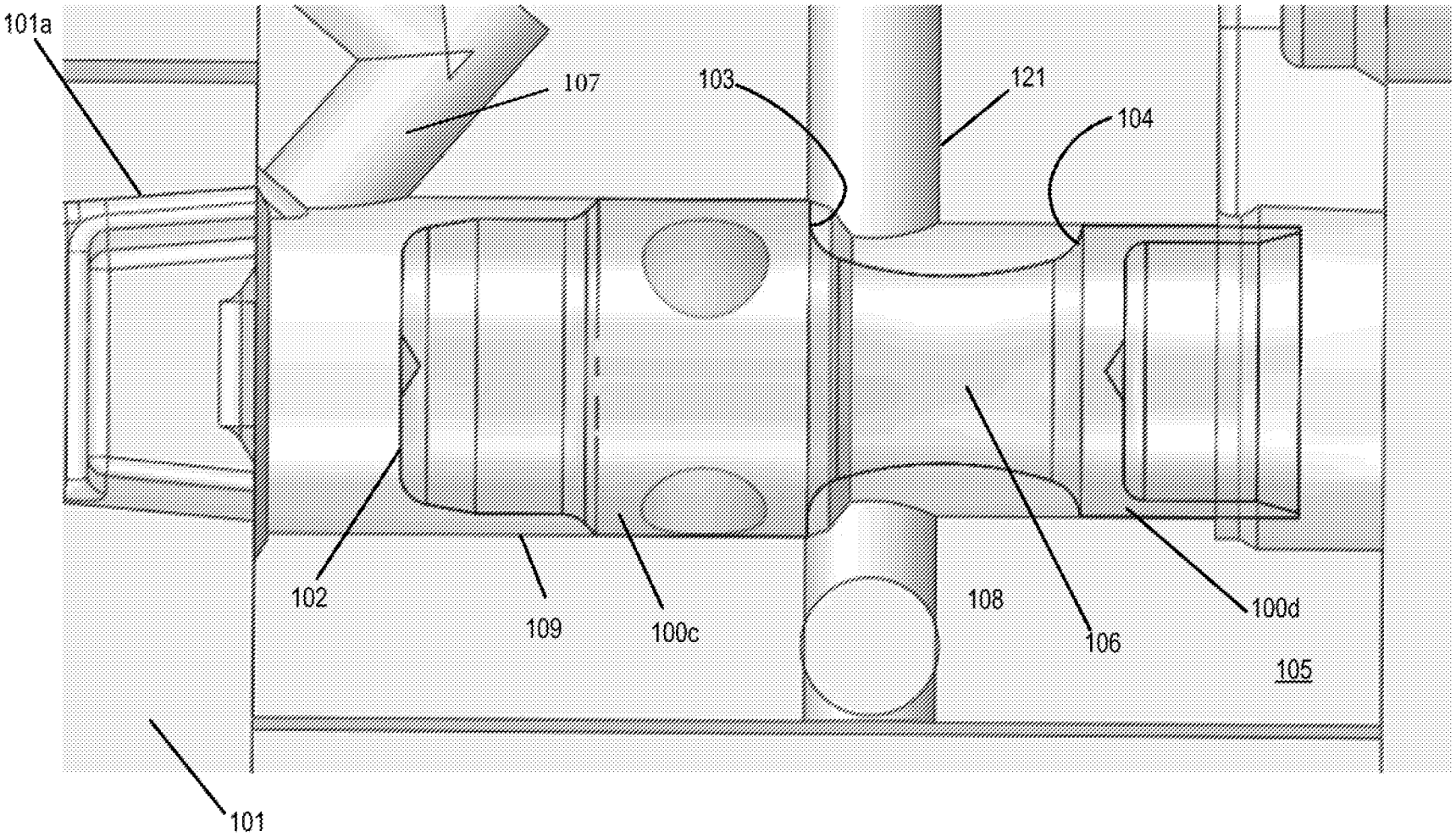
FIG. 8 shows a close up of the lock pin of the first embodiment in the unlocked position during normal phasing operation.
Figure 9:
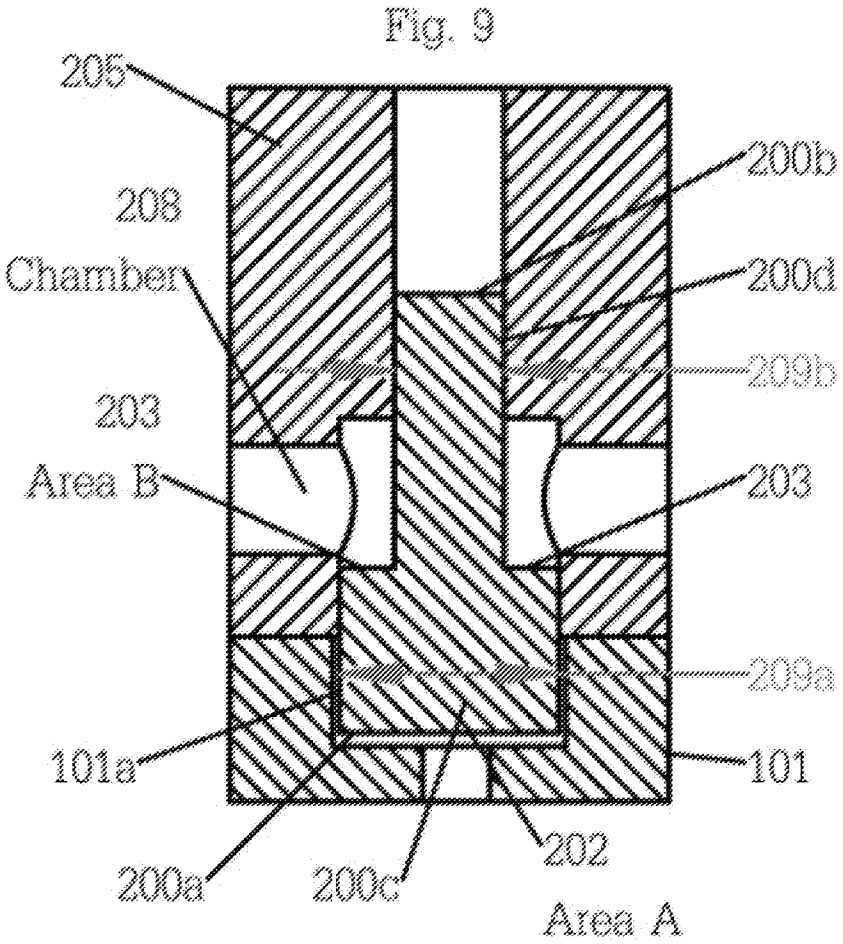
FIG. 9 shows a schematic of a locking the locking pin of a second embodiment.

FIGS. 6 and 8 show a lock pin of a phaser in an unlocked position with the phaser in a normal operation mode. In normal operation mode, engine source oil to the control valve (not shown) is sealed to atmosphere and fluid within chambers formed by the rotor and the housing assembly recirculates between the chambers to phase the rotor relative to the housing. Fluid is also supplied to the first end 100*a* of the lock pin 100 as well as the hydraulic chamber 108. There is a net positive area in the locking direction on the lock pin (direction towards the pin pocket 101*a* of the end plate 101) since Area B 103 is greater than Area C 104. The pressure of the fluid on Area B 103 causes the first end 100*a* of the lock pin 100 to move towards and engage the pin pocket 101*a* of the end plate 101. With the net positive area in the locking direction and the resulting force, the lock pin 100 is prevented from unlocking except when commanded by the ECU. The pin pocket 101*a* is vented to atmosphere when the ECU is commanding the phaser to relock or remain in the locked position. The pressure in the hydraulic chamber 108 is equal to the engine oil pressure.

FIGS. 9-12 show a lock pin 200 with two separate diameters. The first end of the lock pin 200 is received within a pin pocket 201*a* of the end plate 101 of the phaser. Oil pressure in the pin pocket 201*a* may be controlled by the ECU for venting to relock or pressurizing to unlock the nose of the lock pin 200 from the end plate 101.

The first end 200*a* of the lock pin 200 has an Area A 202 and is a top surface of the top line of "T" or first land 200*c*. The under surface of the top line of the "T" forms the second Area B 203. The horizontal line of the "T" may be land 200*c* and the vertical line may be land 200*d*. The lock pin 200 has a locked position in which the first end 200*a* of the lock pin 200 engages a pin pocket 101*a* in an end plate 101 of the phaser, preventing relative movement between a rotor 105 and an end plate 101 of the VCT phaser and an unlocked position in which relative movement between the rotor 105 and the end plate 101 is allowed. It should be noted that Area A 202 corresponds to FIG. 1*b* and that area B 203 corresponds to FIG. 1*c*.

Figure 10:
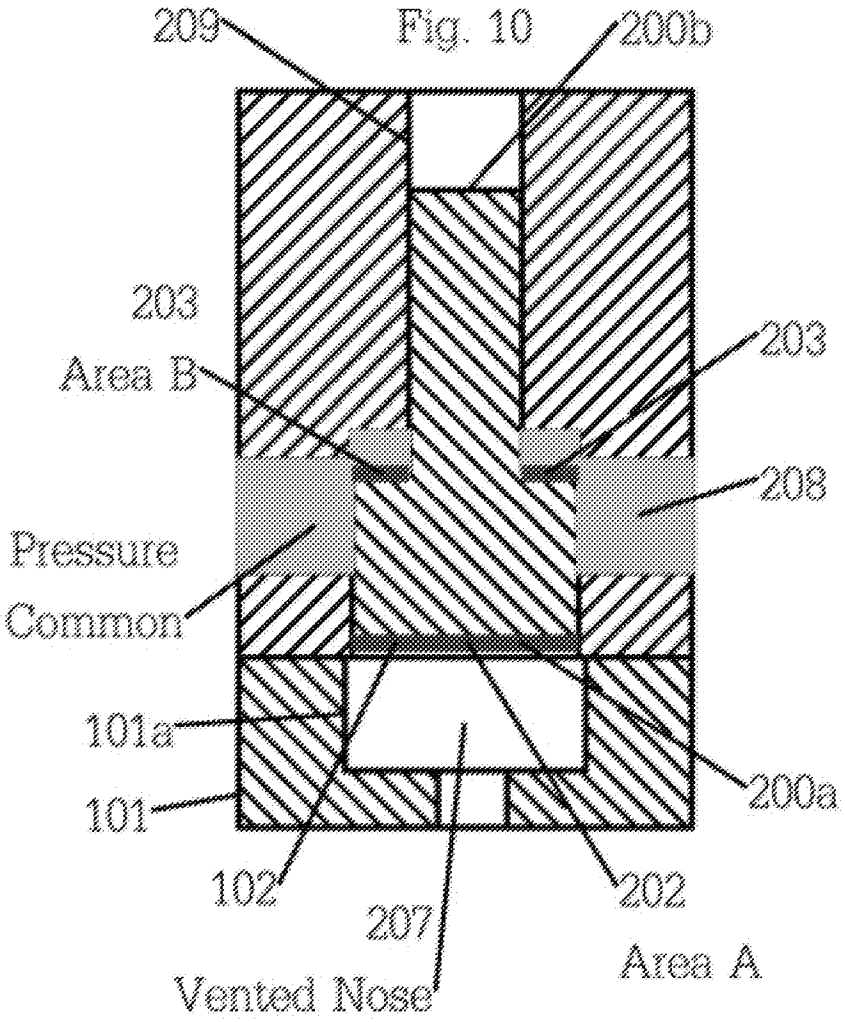
FIG. 10 shows a schematic of relocking the lock pin of a second embodiment.

Referring to FIG. 10, fluid is provided from an engine supply (not shown) to the hydraulic chamber 208. With the fluid in the hydraulic chamber 208, there is a net positive area in the locking direction (direction towards the pin pocket 101*a* of the end plate 101). The pressure of the fluid on area B 203 causes the first end 200*a* of the lock pin 200 to move towards and engage the pin pocket 101*a* of the end plate 101. With the net positive area in the locking direction, the lock pin 200 is prevented from unlocking unless commanded to by the ECU. The pin pocket 101*a* is vented to atmosphere through vent 107 when the ECU is commanding the phaser to lock. The pressure in the hydraulic chamber 208 is equal to the engine oil pressure.

Figure 11:
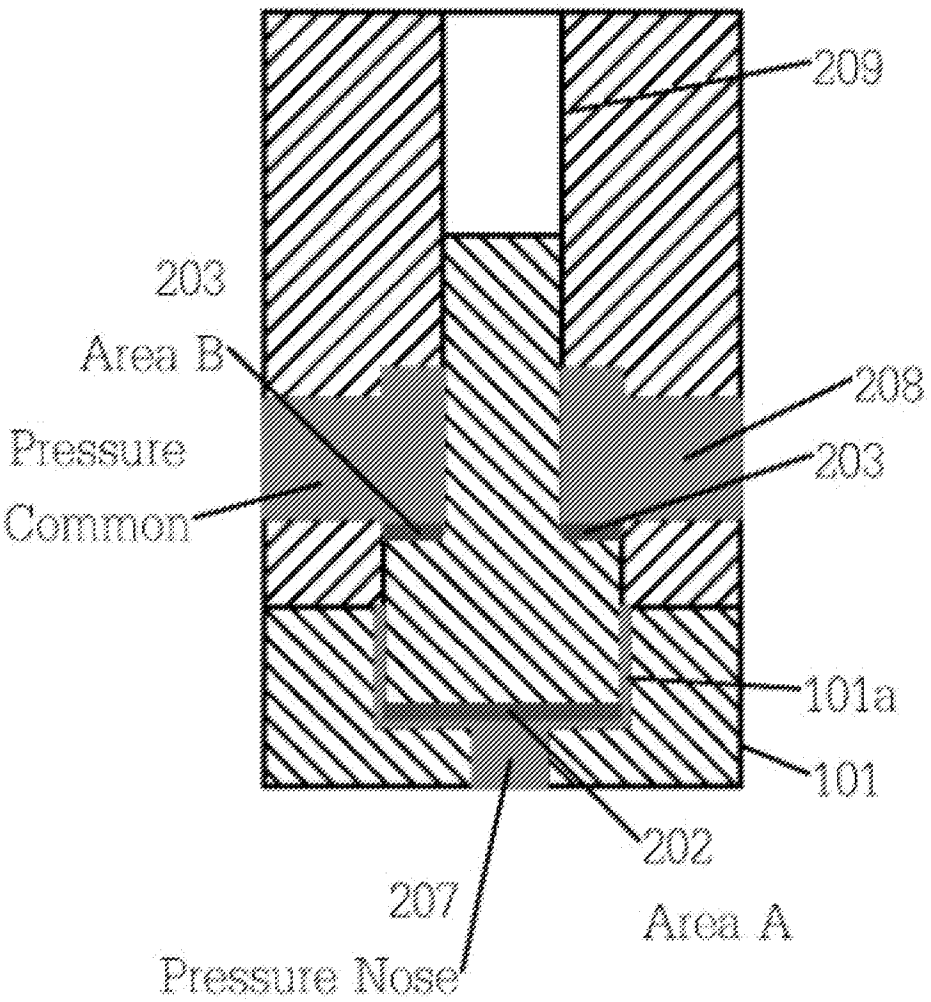
FIG. 11 shows a schematic of unlocking the lock pin of a second embodiment.

FIG. 11 shows the lock pin 200 moving from an unlocked position to a locked position or "relocking". Fluid is provided from an engine supply (not shown) to the hydraulic chamber 208. The lock pin nose area (Area A) 202 and the pin pocket 101*a* is vented to atmosphere. With the fluid in the hydraulic chamber 208, there is a net positive area in the locking direction (direction towards the pin pocket 10*a* of the end plate 101). The pressure in the hydraulic chamber 208 is equal to the engine source oil pressure. The pressure of the fluid on Area B 203 causes the first end 200*a* of the lock pin 200 to move towards and engage the pin pocket 101*a* of the end plate 101.

Figure 12:
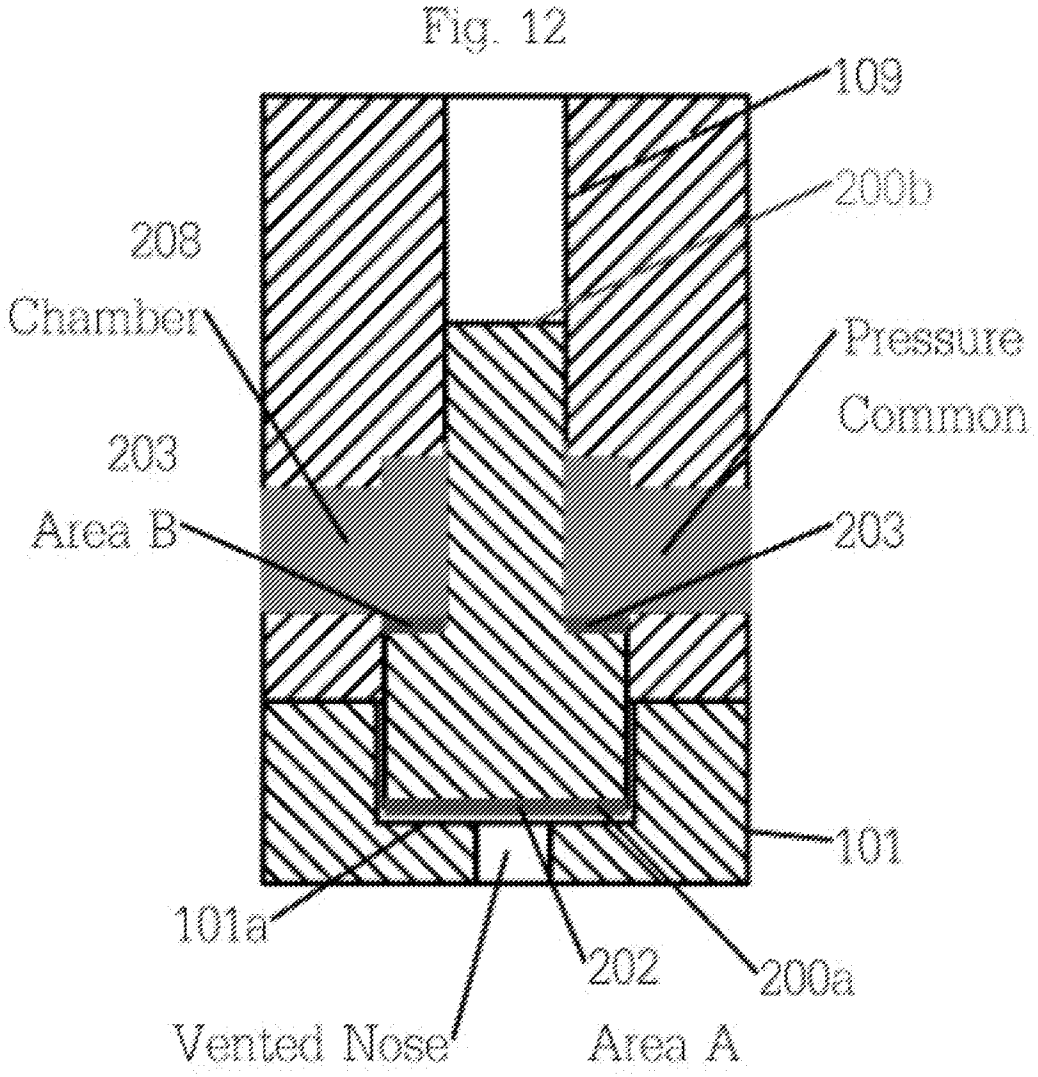
FIG. 12 shows a schematic of locking the lock pin of a second embodiment.

FIG. 12 shows how the lock pin 200 is moved to an unlocked position. To unlock the lock pin 200, fluid is provided from an engine supply (not shown) to the hydraulic chamber 208 as well as to the first end 200*a* of the lock pin 200. With hydraulic fluid being applied to the hydraulic chamber 208 and the first end 200*a* of the lock pin 200, there is a net positive area in an unlocking direction, since fluid is being applied to area A 202, which is greater than area B 203. The lock pin 200 moves in an unlocking direction, such that the first end 200*a* of the lock pin 200 is no longer engaged with the pin pocket 101*a* of the end plate 101. The pressure applied to the hydraulic chamber 208 is equal to the pressure provided to the first end 200*a* of the lock pin by engine source oil pressure.

The length of the lock pin 100, 200 and the length of the lands may vary. The depth of the pin pocket 101*a* may vary. The number of common supply ports to the hydraulic chamber 108, 208 may vary.

A lock pin spring can be added to the second end 100*b*, 200*b* of the lock pin 100, 200 in the locking direction to ensure that at low oil pressures, the lock pin 100, 200 does not become unlocked. However, the lock pin spring is not necessary for the lock pin to move between the locked or unlocked position.

The lock pin 100, 200 of the present invention may be used on all hydraulic VCT devices. It is particularly useful for inducing a force in the locking direction if a different mechanical solution is insufficient for keeping the phaser locked. This invention can be used alone to control a lock pin function (lock/unlock/relock) or in combination with a lock pin spring or other mechanical solution.

It should be noted that one of the advantages of the present invention is that a much higher force may be generated in the locking direction than is available from a spring in the same package (for example, greater than 11N vs. 2N spring force in the locking direction). The lock pin of the present invention can be combined with a spring so that with very low oil pressures and high cam torques (typically in high temperature conditions), the VCT phaser will not unlock. At low temperatures with high oil pressures and high cam torques the oil pressure and resulting net force on chamber 108, 208 is robust at preventing uncommanded unlock.

The force of the hydraulic fluid in the hydraulic chamber 108, 208 on the areas of the lock pin will vary according to engine supply oil pressure. As a result in conditions that may otherwise cause the lock pin to unlock when uncommanded, the lock pin will remain locked due to the net force on chamber 108, 208. The conditions that can cause an uncommanded unlock occur primarily during conditions where the oil pressure is high and the benefit of this invention is maximized. The spring and its spring force do not vary with pressure or temperature.

Accordingly, it is to be understood that the embodiments of the invention herein described are merely illustrative of the application of the principles of the invention. Reference herein to details of the illustrated embodiments is not intended to limit the scope of the claims, which themselves recite those features regarded as essential to the invention.

What is claimed is:

1. A lock pin for a variable cam timing phaser, the lock pin comprising:

a first land including: a first diameter, a first end with a first area, and a second end with a second area less than the first area; and a second land connected to the first land through a reduced diameter, the second land including: a second diameter less than the first diameter, and a first end with a third area less than the first area and the second area;

wherein the first end of the first land is slidably received within a locking recess in an endplate of the variable cam timing phaser.

2. A variable cam timing phaser comprising:

a housing assembly having an outer circumference configured to accept a drive force;

a rotor received within the housing assembly, the rotor having a stepped bore having a first diameter and a second diameter;

a lock pin slidably received within the stepped bore, the lock pin comprising:

a first land including: a first diameter, a first end with a first area, and a second end with a second area less than the first area; and a second land connected to the first land through a reduced diameter, the second land including: a second diameter less than the first diameter, and a first end with a third area less than the first area and the second area; and a hydraulic chamber configured to receive fluid from an engine supply, the hydraulic chamber defined by the stepped bore, the second area, and the third area;

wherein the lock pin is configured to switch between a locked position, in which the first land engages a pocket in an end plate of the housing assembly so as to prevent relative movement between the rotor and the housing assembly, and an unlocked position, in which the first land is disengaged from the pocket;

wherein the lock pin is switched to the unlocked position when the fluid is supplied to the hydraulic chamber and the first area such that the fluid provides a combined force on the first area and the third area that exceeds a force the fluid provides on the second area; and wherein the lock pin is switched to the locked position when the fluid is supplied to the hydraulic chamber such that the force on the second area exceeds the combined force on the first area and the third area.

3. The variable cam timing phaser of claim 2, wherein the fluid is vented from the first area when the lock pin is switched to the locked position.

* * * * *